US011497360B2

(12) United States Patent
Reeback

(10) Patent No.: US 11,497,360 B2
(45) Date of Patent: Nov. 15, 2022

(54) TOILET SEAT LID HAVING AN INTEGRAL LUMBAR BACK SUPPORT

(71) Applicant: Delano Place Enterprise, Scottsdale, AZ (US)

(72) Inventor: Adam Reeback, Scottsdale, AZ (US)

(73) Assignee: Delano Place Enterprise, Scottsdale, AZ (US)

( * ) Notice: Subject to any disclaimer, the term of this patent is extended or adjusted under 35 U.S.C. 154(b) by 0 days.

(21) Appl. No.: 17/375,442

(22) Filed: Jul. 14, 2021

(65) Prior Publication Data

US 2022/0015590 A1 Jan. 20, 2022

Related U.S. Application Data

(60) Provisional application No. 63/051,704, filed on Jul. 14, 2020.

(51) Int. Cl.
*A47K 13/24* (2006.01)

(52) U.S. Cl.
CPC ..... *A47K 13/24* (2013.01)

(58) Field of Classification Search
CPC ..... A47K 13/24
USPC ..... 4/234, 222, 237, 242, 236, 251
See application file for complete search history.

(56) References Cited

U.S. PATENT DOCUMENTS

| | | | | |
|---|---|---|---|---|
| 4,819,278 | A * | 4/1989 | Ramos | A47K 17/02 297/464 |
| 5,197,152 | A * | 3/1993 | Rose | A47K 13/12 4/479 |
| 6,904,622 | B1 * | 6/2005 | Gabriel | A47K 13/005 4/237 |
| 2007/0101487 | A1 * | 5/2007 | Major | A47K 11/04 4/480 |
| 2008/0313796 | A1 * | 12/2008 | Wendt | A47K 13/12 4/234 |
| 2010/0301640 | A1 * | 12/2010 | Heiser | A47C 1/11 297/135 |
| 2014/0130244 | A1 * | 5/2014 | Schottenstein | A47K 13/005 4/234 |
| 2014/0259338 | A1 * | 9/2014 | Welch | A47K 13/06 4/239 |
| 2019/0186115 | A1 * | 6/2019 | Schwab | A47K 10/48 |
| 2020/0138251 | A1 * | 5/2020 | Thrailkill | A47K 11/06 |
| 2021/0106191 | A1 * | 4/2021 | Chung | A61G 7/1019 |

* cited by examiner

*Primary Examiner* — Lori L Baker
(74) *Attorney, Agent, or Firm* — Polsinelli PC

(57) ABSTRACT

A toilet seat lid for a toilet seat having an integral lumbar back support formed along an interior surface of the toilet seat lid and being configured to provide lower back support to a person seated on the toilet seat when leaning against the lumbar back support when the toilet seat lid is in an upright open position relative to the toilet seat are disclosed herein.

8 Claims, 10 Drawing Sheets

TOILET SEAT LID HAVING AN INTEGRAL LUMBAR BACK SUPPORT

CROSS REFERENCE TO RELATED APPLICATIONS

This is a non-provisional application that claims benefit to U.S. provisional application Ser. No. 63/051,704 filed on Jul. 14, 2020, which is herein incorporated by reference in its entirety.

FIELD

The present disclosure generally relates to a seat lid having a back support, and in particular to a toilet seat lid having an integral lumbar back support for supporting the lower back of a person seated on the toilet seat.

BACKGROUND

Toilet seats typically have a seat that forms an opening that communicates with a toilet bowl when the toilet seat is in a closed positioned and in contact with the toilet. In addition, most toilet seats have lids that cover the toilet bowl when flushing the toilet or when the toilet is not in use. Studies have shown that adults spend an average of 3 hours and 9 minutes a week (27 minutes per day) on the toilet. Typically, people spend time on the toilet reading or other activities that can require a person to sit on the toilet seat for extended periods of time. As such, sitting for extended periods of time on the toilet where a person may slouch can cause lower back pain or stress to the person's back. If a person already has a known back problem whether skeletal or muscular, having to sit without back support can be painful and/or can worsen the person's condition. Lumbar support attachments that must be attached to the underside of the lid have been used to provide a degree of lumbar support to a person seating on the toilet seat; however, such lumbar support attachments have several drawbacks. For example, lumbar support attachments that are not permanently affixed to the lid (or seat cover) require the user to physically attach the lumbar support to the underside of the seat cover by either wetting the lumbar attachment or applying an epoxy to the lumbar attachment to affix it properly to the seat cover. Unfortunately, such a lumbar support attachment can become loose or disengaged from the toilet cover over time, thereby requiring continual reattachment over the lifetime of the lumbar support attachment. Additionally, such lumbar attachments if made of "squishy" foam-like or cushioned material that are not hard enough to provide a strong enough resistance to meet and support a person's lower back significantly, thus rendering them ineffective for back support. Finally, there are toilet seat configurations, such as those with deep rims or curved and/or contoured shapes, which can prevent effective engagement of lumbar support attachments to the underside of the lid.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
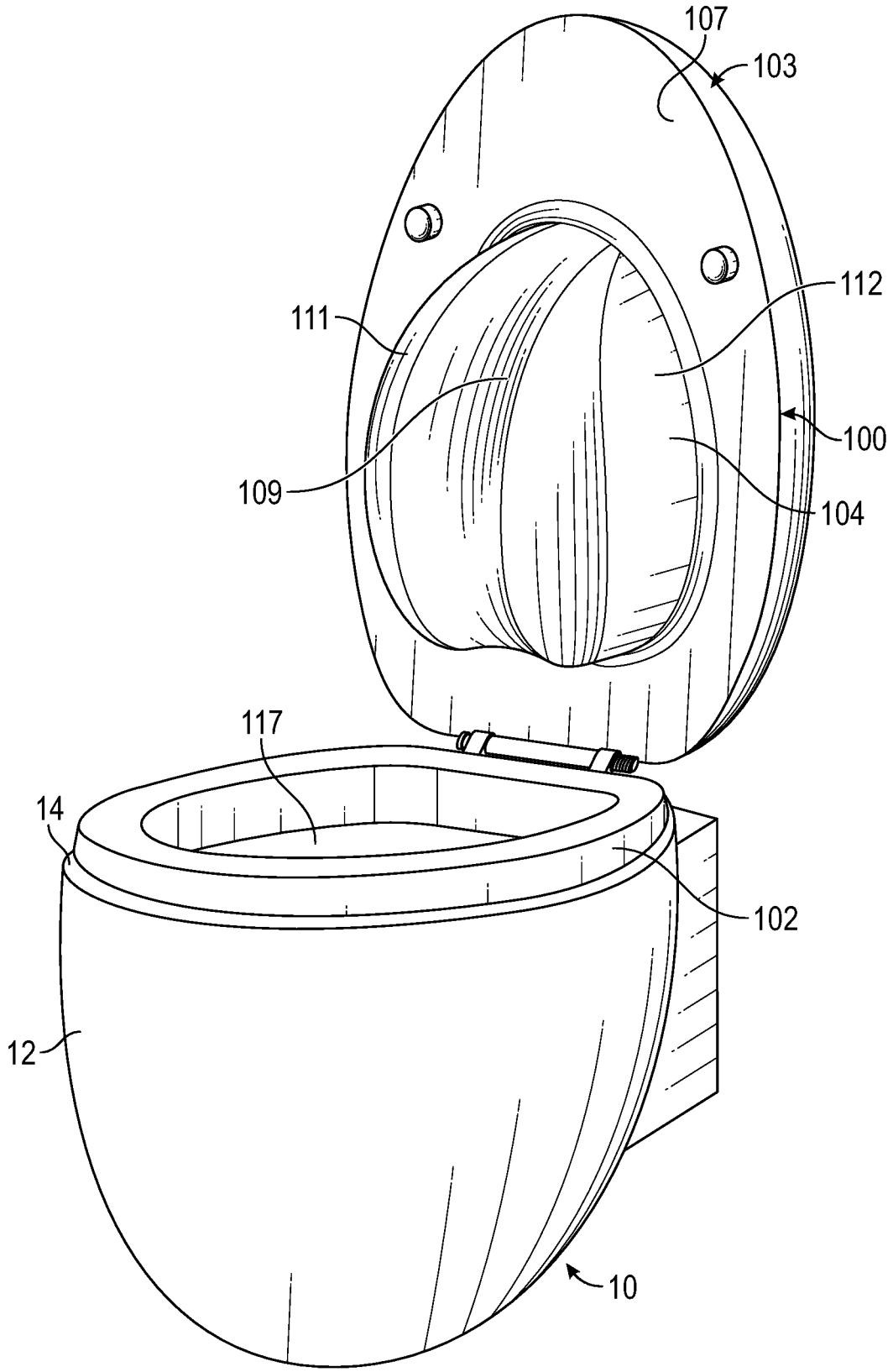
FIG. 1 is a perspective view of a toilet having a toilet seat lid forming an integral lumbar back support coupled to a toilet seat mounted to a toilet bowl.
Figure 2:
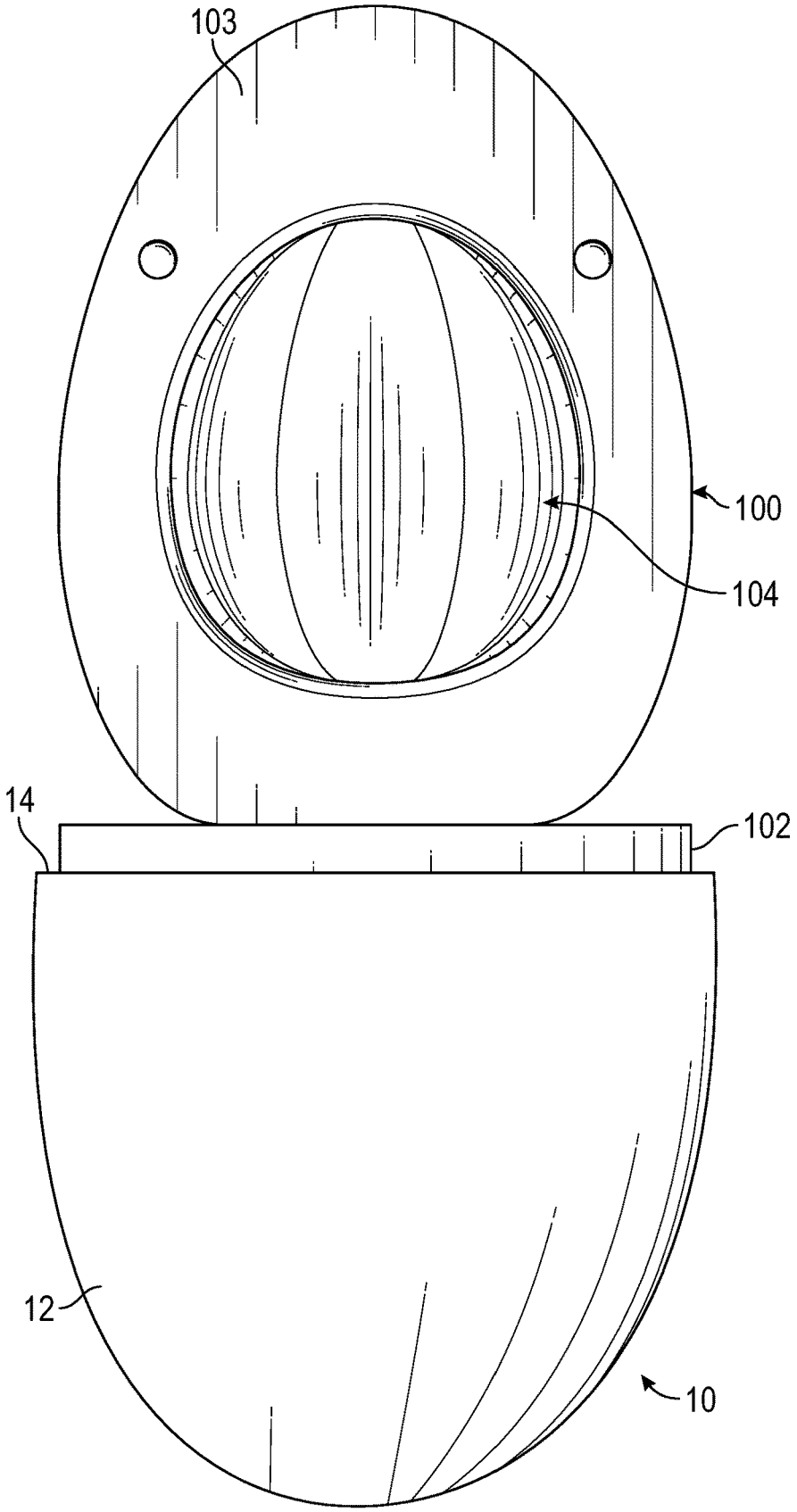
FIG. 2 is a front view of the toilet of FIG. 1 with the toilet seat lid shown in the open position relative to the toilet seat.
Figure 3:
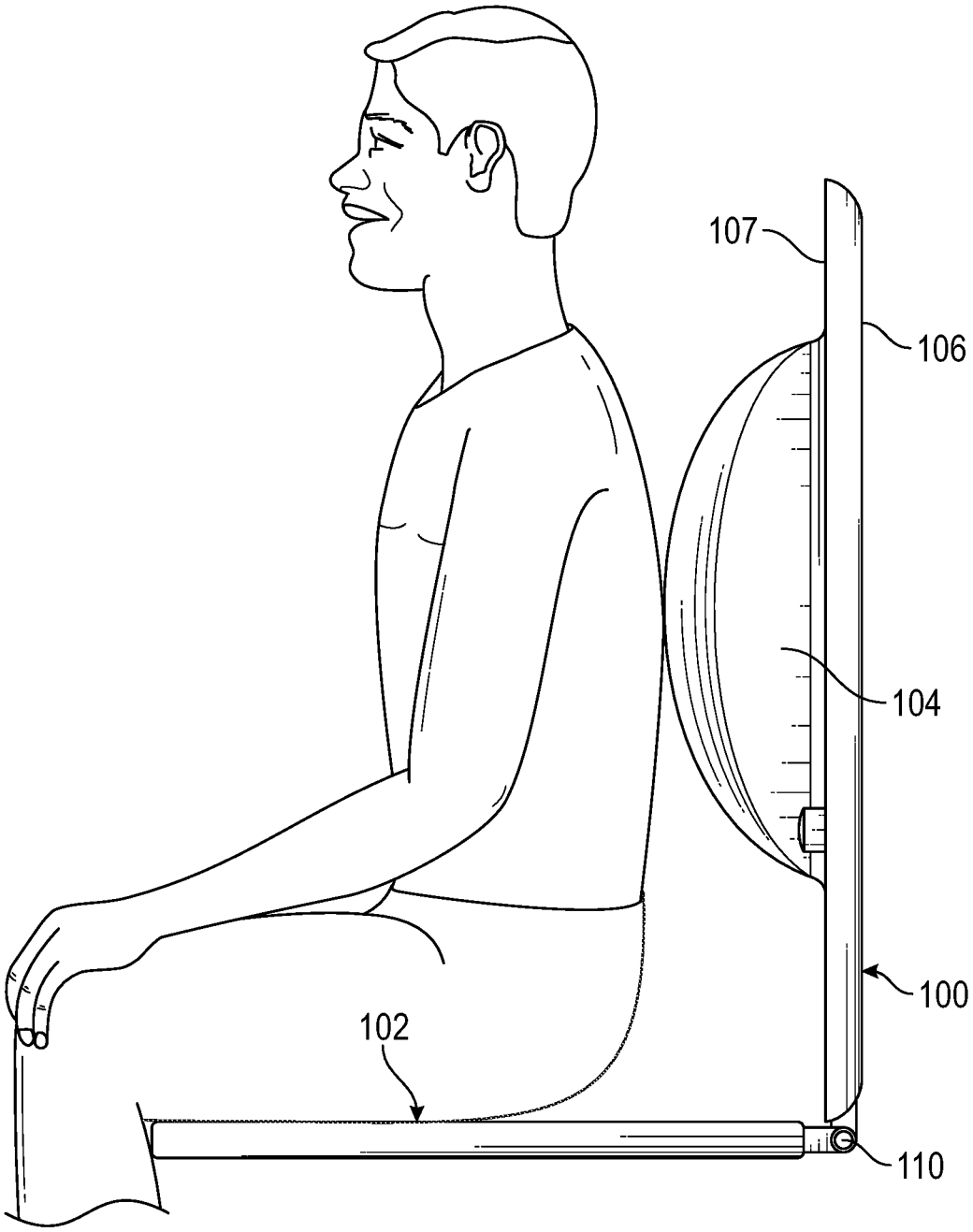
FIG. 3 is a side view of the toilet of FIG. 1 with the toilet seat lid shown in the open position relative to the toilet seat.

Various embodiments of a toilet seat lid having an integral back support that provides lumbar support to a person's back when the toilet seat lid is in an upright open position are disclosed. In some embodiments, the toilet seat lid defines an exterior (top) surface and an interior (underside) surface with the lumbar back support. When the toilet seat lid is in the closed (e.g. down) position, the lumbar back support does not extend substantially beyond the opening formed by the toilet seat such that the lumbar back support does not directly contact the water in the toilet bowl. When the toilet seat lid is in the open (e.g. upright) position, the lumbar back support provides an area of lumbar support to the lower back as the person rests their back against the lumbar back support when seated on the toilet seat. Referring to the drawings, embodiments of a toilet seat lid having an integral lumbar back support are generally indicated as 100 in FIGS. 1-10.

Referring to FIGS. 1-4, an embodiment of a toilet seat lid 100 is shown coupled to a toilet seat 102 through a hinge 110 (FIG. 3), which is affixed to a conventional toilet 10 having a toilet bowl 12 filled with water. The toilet bowl 12 is a conventional toilet bowl defining a toilet bowl rim 14 configured to contact the toilet seat 102 when the toilet seat 102 is in a down position. As shown in FIGS. 5-8, the toilet seat lid 100 forms a seat cover body 103 that forms an exterior (topside) surface 106 and an interior (underside) surface 107. The interior surface 107 of the toilet seat lid 100 defines an integral lumbar back support 104 that extends outwardly from the toilet seat lid 100 and is especially configured to contact and provide lumbar support to the lower back of a person sitting on the toilet seat 102 as shall be discussed in greater detail below.

In some embodiments, the lumbar back support 104 integrally formed with the toilet seat lid 100 may be made of a flexible or cushion-like material that provides a resilient back support that contacts the person's lower back without any specific pressure points being developed between the person's lower back and the lumbar back support 104. In some embodiments, the lumbar back support 104 may be either hollow or solid construction made from a material such as plastic or wood. In one aspect, the configuration of the lumbar back support 104 generally will substantially match the natural human lumbar curve in the person's back.

In addition, the lumbar back support 104 may be considered a medical device that can provide lumbar support to persons having a weak or injured lower back when seated on the toilet seat 102, especially people with chronic back pain. In some embodiments, the lumbar back support 104 may have a curved configuration, a concave configuration, a symmetrical configuration, an asymmetrical configuration, an oval configuration, a circular configuration, and/or a rounded configuration.

Figure 4:
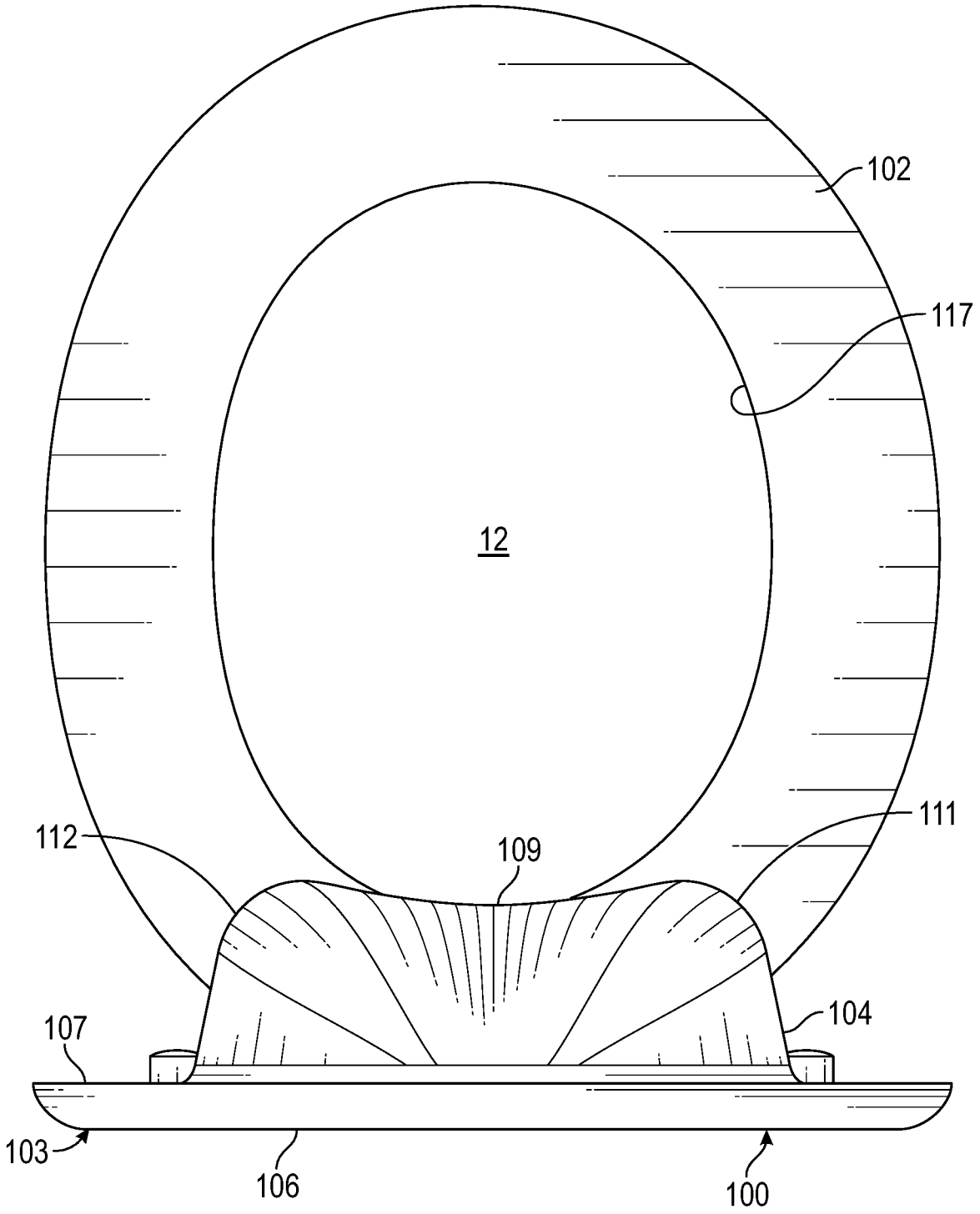
FIG. 4 is a top view of the toilet of FIG. 1 with the toilet seat lid shown in the open position relative to the toilet seat.
Figure 5:
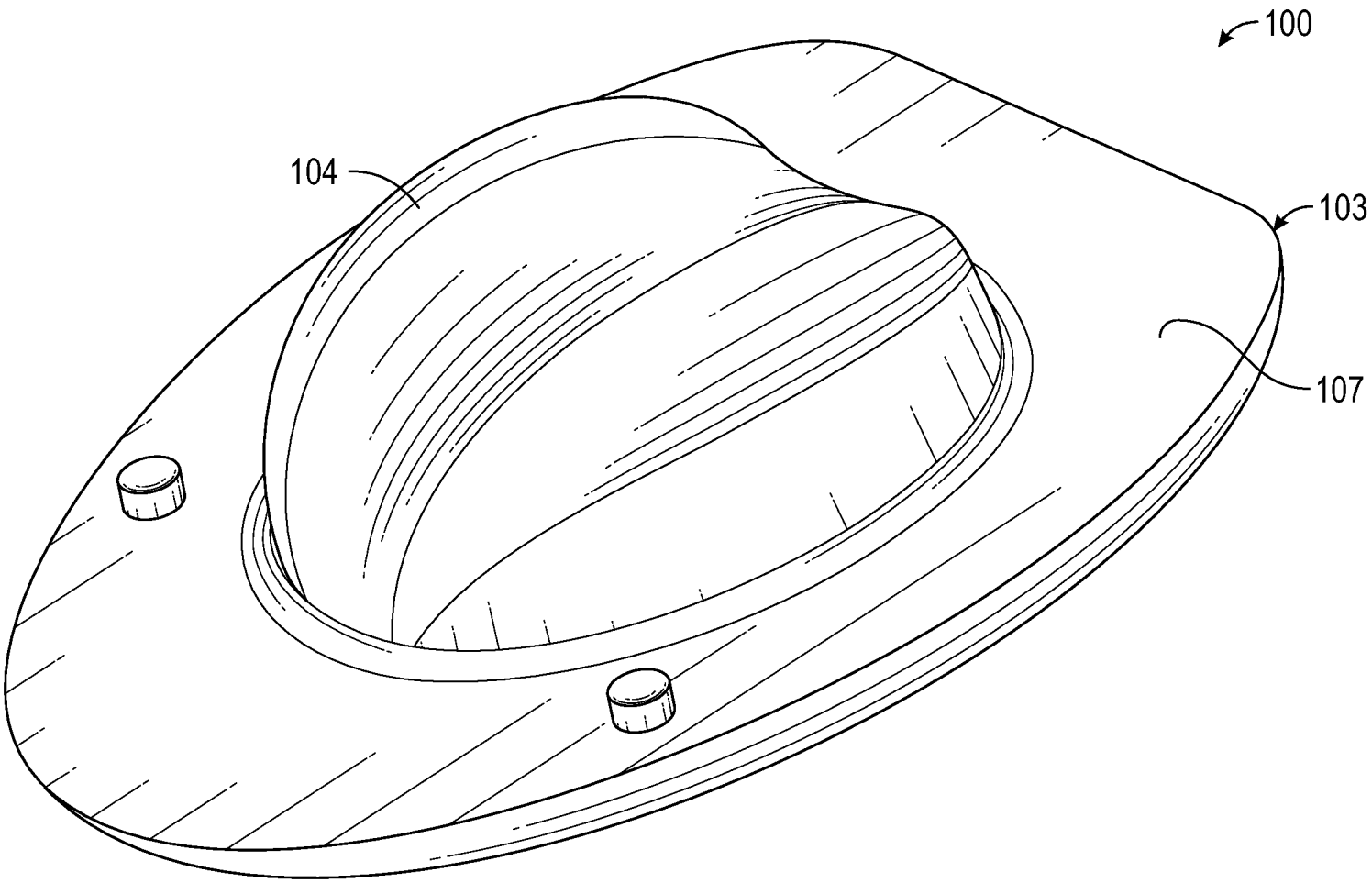
FIG. 5 is perspective view of the toilet seat lid shown in FIG. 1.
Figure 6:
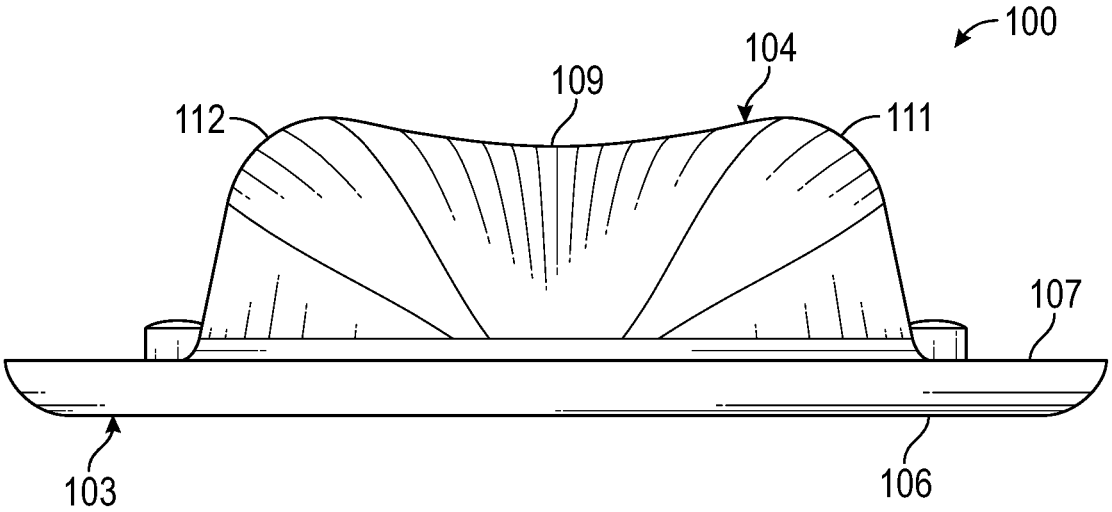
FIG. 6 is an end view of the toilet seat lid shown in FIG. 1.
Figure 7:
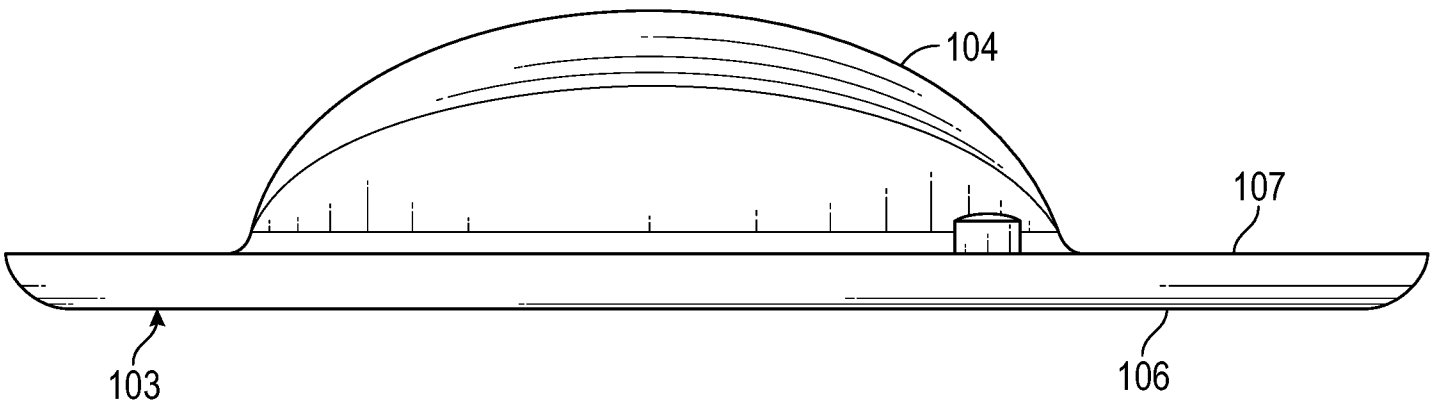
FIG. 7 is a side view of the toilet seat lid shown in FIG. 1.
Figure 8:
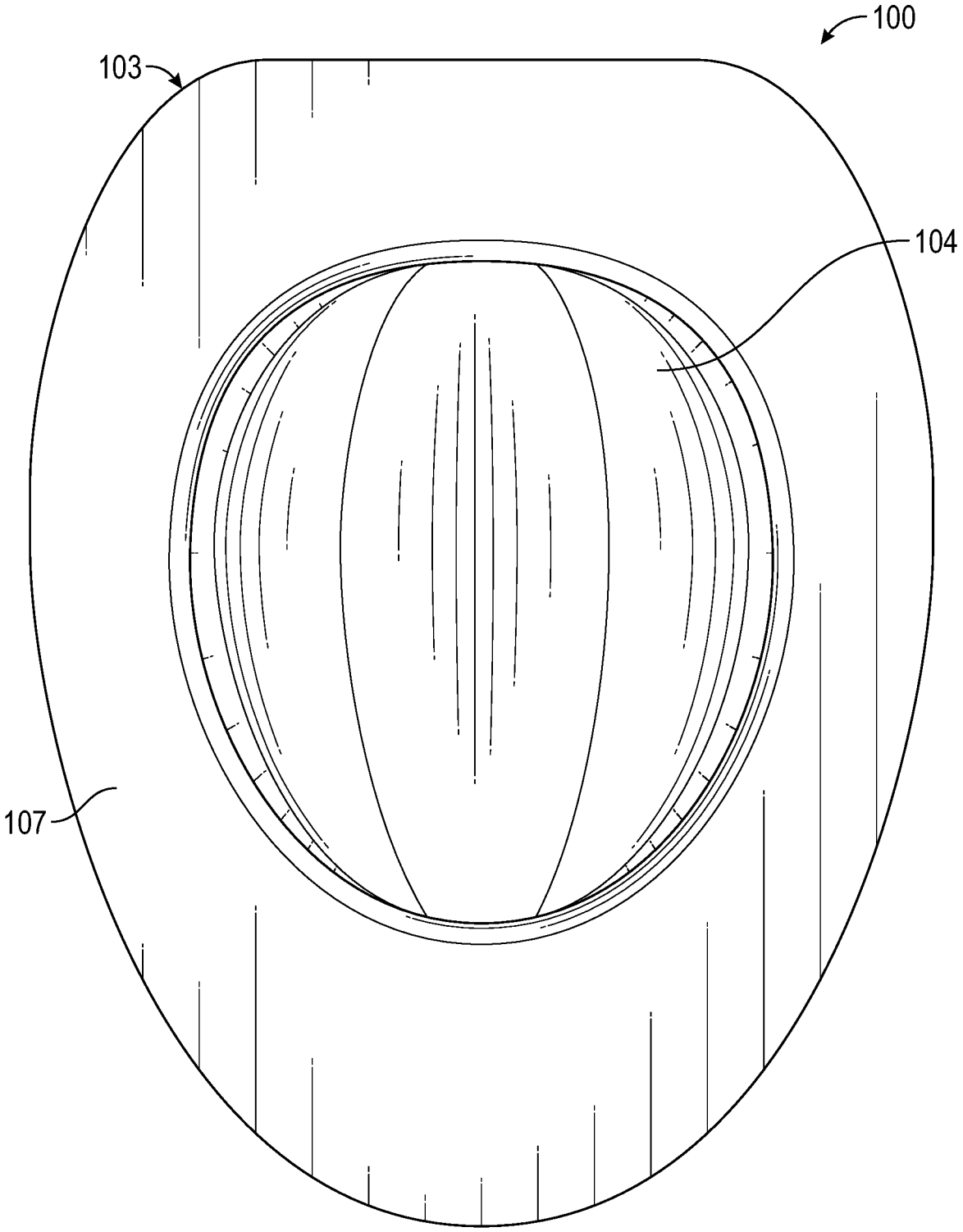
FIG. 8 is a top view of toilet seat lid shown in FIG. 1.

In some embodiments, as shown in FIG. 4, the lumbar back support 104 defines first raised ridge 111 and a second raised ridge 112 with a central vertical recess 109 formed between the first and second raised ridges 111 and 112 to form an ergonomic back-supporting surface. As shown, each of the first and second raised ridges 111 and 112 forms a respective gradual slope with the central vertical recess 109.

Figure 9:
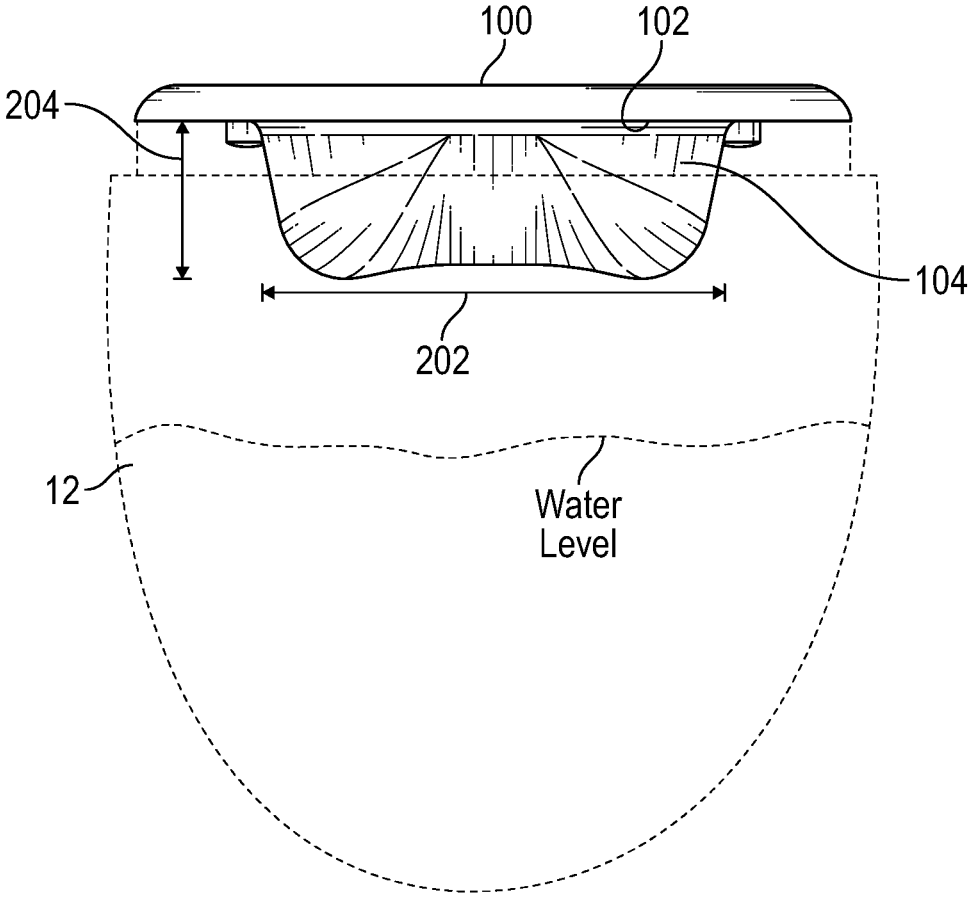
FIG. 9 is an end view of the toilet seat lid of FIG. 1 shown in the closed down position on the toilet seat illustrating the distance the lumbar back support extends beyond the plane of the toilet seat and above the typical water line of the toilet bowl.
Figure 10:
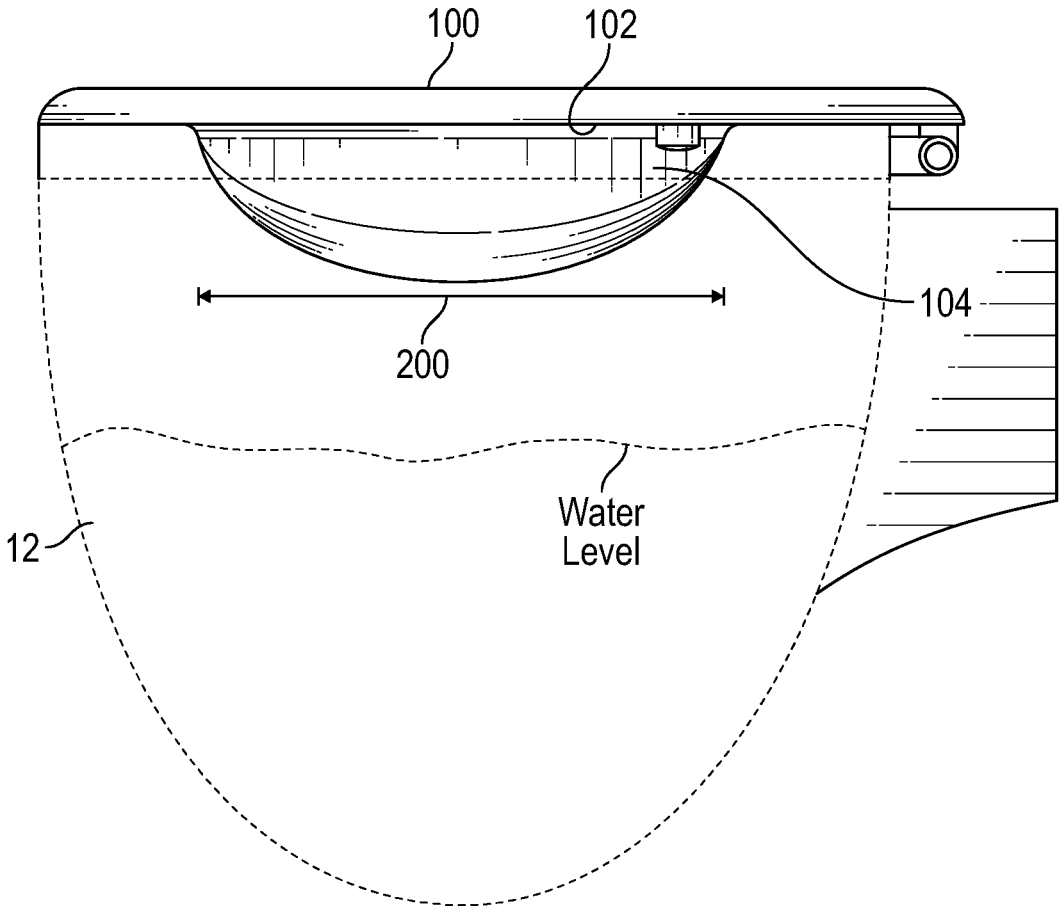
FIG. 10 is a side view of the toilet seat lid of FIG. 1 shown in the closed down position illustrated in FIG. 9.

In some embodiments, as shown in FIGS. 9 and 10, the lumbar back support 104 may have a length 200 of 8.75 inches, a width 202 of 6 inches, and a height 204 of 4.25 inches, although the lumbar back support 104 is configured to comport with different shaped toilet seats 102 having a generally round or oval-shaped configuration. In one aspect, the height of the lumbar back support 104 may be such that the lumbar back support 104 does not extend much beyond the toilet seat 102 and contact the water in the toilet bowl 12 when the toilet seat lid 100 and toilet seat 102 are both in the closed position. For example, in some embodiments the lumbar back support 104 may extend a maximum distance of 4.25 inches from the toilet seat lid 100 when in the closed or shut position such that only 3.5 inches of the lumbar back support 104 extends past the toilet seat 102. In this arrangement, no contact occurs between the lumbar back support 104 with the typical water level in the toilet bowl 12 being about 4 inches below the toilet bowl rim 14, thereby providing sufficient clearance between the lumbar back support 104 and the water level as shown in FIGS. 9 and 10. In one aspect, the lumbar back support 104 is configured to be inserted through the opening 117 formed by the toilet seat 102 when the toilet seat lid 100 contacts the toilet seat 102 in the closed position.

During manufacture of the toilet seat lid 100, the lumbar back support 104 is formed integral with the toilet seat lid 100. In some embodiments, the lumbar back support 104 may be manufactured with toilet seat lids 100 having a generally oval configuration or toilet seat lids 100 having a generally circular configuration in order to accommodate different shapes of conventional toilet seats 102. In some embodiments, the lumbar back support 104 is formed with the toilet seat lid 100 during a molding process that defines the contours of the lumbar back support 104 when forming the exterior and interior surfaces 106 and 107 of the lid 100.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A toilet seat comprising:

a toilet seat that forms an opening;

a toilet seat lid rotatably coupled to the toilet seat, the toilet seat lid having an exterior surface and an interior surface that collectively form an opening; and a lumbar back support integrally formed along the interior surface of the toilet seat lid, the lumbar back support being configured to provide lumbar support to a person seated on the toilet seat with the toilet seat lid in an upright open position and the toilet seat in the closed down position;

wherein the toilet seat lid is operable between the closed down position when the toilet seat lid is in contact with the toilet seat and an open upright position such that the lumbar back support contacts a person seated on the toilet seat along the lower back;

wherein the lumbar back support is configured to pass through the opening formed by the toilet seat when the toilet seat lid and toilet seat are both in the closed down position.

2. The toilet seat of claim 1, wherein the lumbar back support is configured to have a central longitudinal recess defined between opposite raised ridges.

3. A toilet seat comprising:

a toilet seat that forms an opening;

a toilet seat lid rotatably coupled to the toilet seat, the toilet seat lid having an exterior surface and an interior surface that collectively form an opening; and a lumbar back support integrally formed along the interior surface of the toilet seat lid, the lumbar back support being configured to provide lumbar support to a person seated on the toilet seat with the toilet seat lid in an upright open position and the toilet seat in the closed down position, wherein the toilet seat lid is operable between the closed down position when the toilet seat lid is in contact with the toilet seat and an open upright position such that the lumbar back support contacts a person seated on the toilet seat along the lower back;

wherein the lumbar back support is configured to extend no farther than 4.25 inches beyond the opening of the toilet seat when the lid is in the closed down position.

4. The toilet seat of claim 1, wherein the lumbar back support is made from a flexible material.

5. The toilet seat of claim 1, further comprising:

a hinge member coupled to the toilet seat and the toilet seat lid for allowing rotation of the lid relative to the toilet seat.

6. A method of manufacturing a lid for a toilet seat comprising:

forming a toilet seat that forms an opening;

forming a toilet seat lid rotatably coupled to the toilet seat, the toilet seat lid having an exterior surface and an interior surface that collectively form an opening; and forming a lumbar back support integrally formed along the interior surface of the toilet seat lid, the lumbar back support being configured to provide lumbar support to a person seated on the toilet seat with the toilet seat lid in an upright open position and the toilet seat in the closed down position, wherein the toilet seat lid is operable between the closed down position when the toilet seat lid is in contact with the toilet seat and an open upright position such that the lumbar back support contacts a person seated on the toilet seat along the lower back.

7. The method of claim 6, wherein forming the lumbar back support further comprises defining a central valley extending between a first raised ridge and a second raised ridge formed along the lumbar back support.

8. The method of claim 6, wherein forming the toilet seat lid is manufactured using a molding process that molds the lumbar back support with the toilet seat lid.

* * * * *